US012557883B2

(12) United States Patent
Lavigne

(10) Patent No.: US 12,557,883 B2
(45) Date of Patent: Feb. 24, 2026

(54) SYSTEM FOR INTERLOCKING FASTENER

(71) Applicant: Landon James Lavigne, West Hollywood, CA (US)

(72) Inventor: Landon James Lavigne, West Hollywood, CA (US)

( * ) Notice: Subject to any disclaimer, the term of this patent is extended or adjusted under 35 U.S.C. 154(b) by 242 days.

(21) Appl. No.: 18/071,245

(22) Filed: Nov. 29, 2022

(65) Prior Publication Data

US 2024/0172844 A1 May 30, 2024

(51) Int. Cl.
*A44B 11/25* (2006.01)

(52) U.S. Cl.
CPC ..... *A44B 11/25* (2013.01); *A44D 2203/00* (2013.01)

(58) Field of Classification Search
CPC ... A44B 11/25; A44B 11/258; A44B 11/2596; A44D 2203/00; Y10T 24/32; A44C 5/2066; A44C 5/2076; A44C 5/2071
See application file for complete search history.

(56) References Cited

U.S. PATENT DOCUMENTS

| | | | | |
|---|---|---|---|---|
| 2,648,884 | A * | 8/1953 | Loofboro | A44C 5/2071 24/303 |
| 3,293,714 | A | 12/1966 | Shafer | |
| 3,589,341 | A * | 6/1971 | Krebs | A01K 27/005 24/303 |
| 5,432,986 | A | 7/1995 | Sexton | |
| 5,678,282 | A | 10/1997 | Stewart | |
| 6,481,065 | B2 * | 11/2002 | Cogdill | C07K 14/50 24/575.1 |
| 6,640,398 | B2 | 11/2003 | Hoffman | |
| 6,857,169 | B2 | 2/2005 | Chung | |
| 9,049,894 | B2 | 6/2015 | Wong | |
| 10,085,521 | B2 * | 10/2018 | Chen | A45C 13/1069 |
| 10,143,270 | B2 * | 12/2018 | Fiedler | A44B 11/2588 |
| 11,006,705 | B2 | 5/2021 | Hatanaka | |
| 11,076,652 | B2 * | 8/2021 | Fiedler | A41F 1/002 |
| 11,083,251 | B2 * | 8/2021 | Fiedler | A44C 5/2071 |
| 11,160,337 | B1 | 11/2021 | Plotner | |
| 11,825,918 | B2 * | 11/2023 | Stearns | F16B 1/00 |
| 2023/0329399 | A1 * | 10/2023 | Zook | A44B 11/2561 |

OTHER PUBLICATIONS https://www.walmart.com/ip/Universal-Magnetic-Buckle-Belt-Side-Release-Buckle-DIY-Belt-Buckle-For-Belt-Backpack-Luggage/646680112.

* cited by examiner

*Primary Examiner* — Jason W San
*Assistant Examiner* — Louis A Mercado
(74) *Attorney, Agent, or Firm* — Lisa Foundation Patent Clinic; Anthony Jens Bonfiglio

(57) ABSTRACT

A fastening apparatus and fastener for interconnecting a strap are disclosed, where such fastening apparatus may made of two interlocking members. Each interlocking member includes a first elongated portion, a second elongated portion, and bridge portion disposed between the first elongated portion and second elongated portion. One elongated portion may be longer than the other elongated portion. A ridge may be disposed along one of the elongated portions and a groove may be disposed along the other elongated portion. One or more magnets may be embedded in any of the two elongated portions or bridge portion. The fastening apparatus may be joined together by rotating one interlocking member by 180 degrees relative to the other interlocking member and sliding the two members together. The ridge and groove of one interlocking member slidably engages with the corresponding groove and corresponding ridge of the other interlocking member, respectively.

20 Claims, 5 Drawing Sheets

SYSTEM FOR INTERLOCKING FASTENER

CROSS REFERENCE TO RELATED APPLICATIONS

Not Applicable

BACKGROUND

1. Field of the Invention

The present invention relates generally to fasteners for interconnecting straps, belts, ropes, chains, or the like.

2. Description of Related Art

Buckles, clasps, and similar fasteners come in numerous designs and employ many functional means for securing two ends of a strap together. Such fasteners are used to secure a wide variety of items including waist belts, watch bands, articles of jewelry, shoes, and suitcases. Some conventional fastening devices, such as frame and prong buckles, snap-fit buckles, and hook-and-eye clasps, continue to be widely used with modern consumer products. Despite this, current fastening devices continue to possess numerous shortcomings that have yet to be resolved.

"Frame and prong" buckles, which are commonly used to secure wrist watches and waist belts, have existed for thousands of years with relatively little change to their underlying design. Most frame and prong buckles are comprised of a rectangular frame and a prong pivotally mounted to the frame. One end of a belt is attached to the frame, while a second end of the belt is free. At the free end, one or more holes are formed through the belt material for receiving the prong. The free end of the belt may be secured to the other end by inserting it into the frame and pushing the prong through one of the holes, thereby forming a loop around a wearer's waist or wrist. While the frame and prong buckle serves its intended purpose, it is not without its shortcomings. Use of a belt and prong design necessarily requires there to be holes punched through the belt, causing irreparable damage to the belt material. Additionally, when the free end of the belt is secured through the frame, there is a portion of the belt that overlaps with itself, resulting in increased bulkiness along that portion. In turn, the increased bulkiness reduces the comfort to the user, damages aesthetic appearances by introducing asymmetry, and creates a protrusion that can snag on clothing or other items.

Other fastening devices have been developed to overcome the shortcomings associated with frame and prong buckles. For instance, some fastening devices provide a fastening component on both ends of a strap, thereby eliminating the need to force a prong through belt material. However, many of these fasteners comprise a male fastening component on one end and a differently configured female fastening component on the other end. For instance, snap-fit or side release buckles, which are commonly used to connect strapped items such as personal floatation jackets, safety harnesses, backpacks, and fanny-packs, are comprised of a male buckle component and a female buckle component. The male buckle component comprises a base, two prongs extending from the base, and a retaining block located on the distal end of each prong. The female buckle component is configured to receive the male buckle component and comprises a frame with a front opening and two side openings. When the male buckle component is inserted into the front opening of the female buckle component, the two retaining blocks fit into the side openings and lock the two components together. The two components may be disengaged by pushing the two retaining blocks together to unlock them from the side openings.

Despite their widespread use, side release buckles, and other similar fasteners that utilize male and female components, continue to present their own set of problems. For example, fastener designs that involve a female component and a counterpart male component necessarily require the male component to be configured differently to the female component. Consequently, the male and female components must be manufactured according to separate manufacturing processes, resulting in greater manufacturing expense and complexity. Furthermore, even when in an interlocked position, geometrical differences between the male and female components can introduce aesthetic asymmetries that negatively impact the aesthetic appearance of the fastener. Moreover, in order to be properly secured together, male and female fastening components must be oriented relative to one another such that the receiving portion correctly joins with the inserting portion. Accordingly, use of this type of fastening device requires manual alignment of the two components. As a result, users commonly encounter difficulties with securing the fastener when they need to secure it quickly or when they need to secure it without seeing it. Thus, there exists a need for a fastener that is easy to use, compact, comfortable, secure, and aesthetically symmetrical.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 6,857,169 discloses a magnetic buckle comprising a male buckle and a female buckle. The male buckle comprises a base portion and a buckling portion comprising a buckling element, a protruded buckling block, and an inlayed magnetic element. The female buckle comprises a base portion and a buckling portion comprising a sit-in-groove having a buckling groove, and an inlayed magnetic element. Disposed on the base portion of each of the female buckle and the male buckle is a through channel for attachment to a knitted belt. The magnetic elements of the male and female buckles attract each other. The buckling element of the male buckle fits into the fit-in-groove of the female buckle.

U.S. Pat. No. 6,640,398 discloses a magnetic clasp for the securing the opposed end of chains and other jewelry. The clasp comprises two mating body members. Each mating body member comprises a frame with a slot, a cylindrical magnet disposed inside the slot, a distal end member disposed next to the magnet, and a proximal end member. The distal end member and magnet of one mating body member fits into the space between the magnet and proximal end member of the other mating body member. Flanges are disposed on the proximal end members of each mating body member for attaching a chain.

U.S. Pat. No. 11,160,337 discloses a magnetic jewelry attachment assembly comprising a pair of cases, a plurality of layers of magnetic material on the cases, a pair of hollow cavities each formed in one of the cases, and a pair of securement devices each being mounted to one of the cases. The cases have identical constructions and are placed in relatively inverted orientation with respect to one another. The cases are formed as elongated bodies having opposing stepped configurations. When the cases are brought close to and aligned with one another, the layers of magnetic material on the cases magnetically attracts the cases together.

U.S. Pat. No. 11,006,705 discloses a clasp assembly comprising a plurality of releasable link assemblies. Each releasable link assembly comprises a receptacle link and a latching link pivotally coupled to the receptacle link. The latching link of one releasable link assembly is configured to releasably couple to the receptacle link of another releasable link assembly. The latching link includes a first engagement structure that is configured to slidably engage with a second engagement structure (a channel) on a receptacle link of another releasable link assembly.

U.S. Pat. No. 3,293,714 discloses a safety buckle which utilizes magnets to hold the buckle in an attitude for locking opposite ends of a belt together. The safety buckle includes two identical locking members. Each locking member includes a substantially flat belt holder, an offset plate extending outward from the plane of the belt holder, an extension plate parallel to the belt holder, a stop plate extending perpendicular to the extension plate, a retainer plate formed parallel to the extension plate, and a bar magnet fixed to the retainer plate. An open-ended channel having a general U-shaped cross-section is formed by the extension plate, the retainer plate, and the stop plate. The locking members are placed adjacent to each other and the mutual attraction of the magnets holds the magnets in firm engagement.

U.S. Pat. No. 5,432,986 discloses a magnetic fastener for jewelry and belts. The magnetic fastener comprises a receiving member and an inserting member. The receiving member has a base, walls extending perpendicularly from the periphery of the base, a wafer of magnetic material disposed in the recessed area created by the walls, a notch in the walls, and an attachment means disposed on one end of the receiving member. The inserting member comprises a base, a wafer of magnetic material attached to the base, a tab, and an attachment means disposed on one end of the inserting member. The fastener is closed by inserting the inserting member into the receiving member so that the wafer of magnetic material on the inserting member goes into the recess of the receiving member and the tab goes into the notch.

U.S. Pat. No. 5,678,282 discloses a jewelry clasp comprising a pair of opposite interlocking members. Each of the interlocking members has a top portion, a bottom portion, a forward end, and a rearward end. Each interlocking member has forward end tines with a transverse bore extending therethrough. The tines of opposing interlocking member interlock together when in a closed position. A pin is inserted into the bores to lock the interlocking members together in a closed position.

U.S. Pat. No. 9,049,894 discloses a magnetic strap fastener comprising a first magnetic strap fastener part and a second magnetic strap fastener part. Each of the fastener parts comprise a magnet slab, a magnetic housing embracing the magnetic slab, a strap attachment means, and stop. An elongate slot is formed intermediate the magnet slab and the strap attachment means for receiving a stop of a counterpart fastener part. The stop and the slot are in an interlocked relationship when the fastener is in magnetic coupling engagement.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY

The present invention provides among other things a fastening apparatus for interconnecting a strap that satisfies the need for a fastener that is easy to use, compact, comfortable, secure, and aesthetically symmetrical.

In one embodiment, the fastening apparatus includes a first interlocking member and a second interlocking member that are each configured to removably engage with one another. The first interlocking member includes a first elongated portion, a second elongated portion, and a first bridge portion. The first elongated portion comprises a first engagement surface and a first ridge disposed along the first engagement surface. A first magnet is embedded in the first elongated portion. The second elongated portion comprises a second engagement surface, a first groove disposed along the second engagement surface, and a first attachment surface that is distal to the second engagement surface. A second magnet is embedded in the second elongated portion. The first bridge portion comprises a first end and a second end. The first end is coupled to the first engagement surface and the second end is coupled to the first attachment surface. The second interlocking member is configured to removably engage with the first interlocking member and includes a third elongated portion, a fourth elongated portion, and a second bridge portion. The third elongated portion comprises a third engagement surface and a second ridge disposed along the third engagement surface. The second ridge is configured to slidably engage with the first groove. A third magnet is embedded in the third elongated portion and is configured to attract the first magnet. The fourth elongated portion comprises a fourth engagement surface, a second groove disposed along the fourth engagement surface, and a second attachment surface that is distal to the fourth engagement surface. The second groove is configured to slidably engage with the first ridge. A fourth magnet is embedded in the fourth elongated portion and is configured to attract the second first magnet. The second bridge portion comprises a third end and a fourth end. The third end is coupled to the third engagement surface and the fourth end is coupled to the fourth attachment surface.

In one embodiment, an open-ended channel having a substantially U-shaped cross-section is formed by the first elongated portion, the second elongated portion, and the first bridge portion. An open-ended channel having a substantially U-shaped cross-section is formed by the third elongated portion, the fourth elongated portion, and the second bridge portion In one embodiment, a first overhang portion configured to couple to a strap extends from the first interlocking member. A second overhang portion configured to couple to a strap extends from the second interlocking member.

In one embodiment, the first overhang portion comprises a first channel therethrough, and the second overhang portion comprises a second channel therethrough.

In one embodiment, a first rod extends coaxially along the first channel, and a second rod extends coaxially along the second channel.

In one embodiment, a contact surface of the fastening apparatus is curved.

In one embodiment, a contact surface of the fastening apparatus is planar.

In one embodiment, the first elongated portion is longer than the second elongated portion, and the third elongated portion is longer than the fourth elongated portion.

In one embodiment, the second elongated portion is longer than the first elongated portion, and the fourth elongated portion is longer than the third elongated portion.

In one embodiment, the second magnet has a polarity orientation opposite to a polarity orientation of the first magnet, and the fourth magnet has a polarity orientation opposite to a polarity orientation of the third magnet.

In another embodiment, the invention discloses an interlocking member comprising a first elongated portion, a second elongated portion, a first bridge portion, a first ridge, a first groove, and a first magnet. The first bridge portion is disposed between the first elongated portion and the second elongated portion. The first ridge is located on at least one of the first elongated portion and the second elongated portion. The first groove is located on at least one of the first elongated portion and the second elongated portion. The first magnet is coupled to at least one of the first elongated portion, the second elongated portion, and the first bridge portion.

In one embodiment, an open-ended channel having a substantially U-shaped cross-section is formed by the first elongated portion, the second elongated portion, and the first bridge portion.

In one embodiment, a first overhang portion configured to couple to a strap extends from the first elongated portion.

In one embodiment, the first overhang portion comprises a first channel therethrough.

In one embodiment, a first rod extends coaxially along the first channel.

In one embodiment, a contact surface of the interlocking member is curved.

In one embodiment, a contact surface of the interlocking member is planar.

In one embodiment, the first elongated portion is longer than the second elongated portion.

In one embodiment, the second elongated portion is longer than the first elongated portion.

In one embodiment, the second magnet has a polarity orientation opposite to a polarity orientation of the first magnet.

In another embodiment, the invention discloses a first interlocking member and a second interlocking member. The first interlocking member comprises a first elongated portion, a second elongated portion, a first bridge portion, and a first ridge. The first bridge portion is disposed between the first elongated portion and the second elongated portion. The first ridge is located on at least one of the first elongated portion and the second elongated portion. The second interlocking member is configured to removably engage with the first interlocking member and comprises a third elongated portion, a fourth elongated portion, a second bridge portion, and a first groove. The second bridge portion is disposed between the third elongated portion and the fourth elongated portion. The first groove is located on at least one of the third elongated portion and the fourth elongated portion. The first groove is configured to slidably engage with the first ridge.

In one embodiment, an open-ended channel having a substantially U-shaped cross-section is formed by the first elongated portion, the second elongated portion, and the first bridge portion. An open-ended channel having a substantially U-shaped cross-section is formed by the third elongated portion, the fourth elongated portion, and the second bridge portion In one embodiment, a first magnet is coupled to at least one of the first elongated portion, the second elongated portion, and the first bridge portion. A second magnet is coupled to at least one of the third elongated portion, the fourth elongated portion, and the second bridge portion. The second magnet is configured to attract the first magnet.

In one embodiment, a first overhang portion configured to couple to a strap extends from the first interlocking member. A second overhang portion configured to couple to a strap extends from the second interlocking member.

In one embodiment, the first overhang portion comprises a first channel therethrough, and the second overhang portion comprises a second channel therethrough.

In one embodiment, a first rod extends coaxially along the first channel, and a second rod extends coaxially along the second channel.

In one embodiment, a contact surface of the fastening apparatus is curved.

In one embodiment, a contact surface of the fastening apparatus is planar.

In one embodiment, the first elongated portion is longer than the second elongated portion, and the third elongated portion is longer than the fourth elongated portion.

In one embodiment, the second elongated portion is longer than the first elongated portion, and the fourth elongated portion is longer than the third elongated portion.

In one embodiment, the fastening apparatus further comprises a second groove located on at least one of the first elongated portion, the second elongated portion, the third elongated portion, and the fourth elongated portion. The fastening apparatus further comprises a second ridge located on at least one of the first elongated portion, the second elongated portion, the third elongated portion, and the fourth elongated portion. The second ridge is configured to slidably engage with the second groove.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1A:
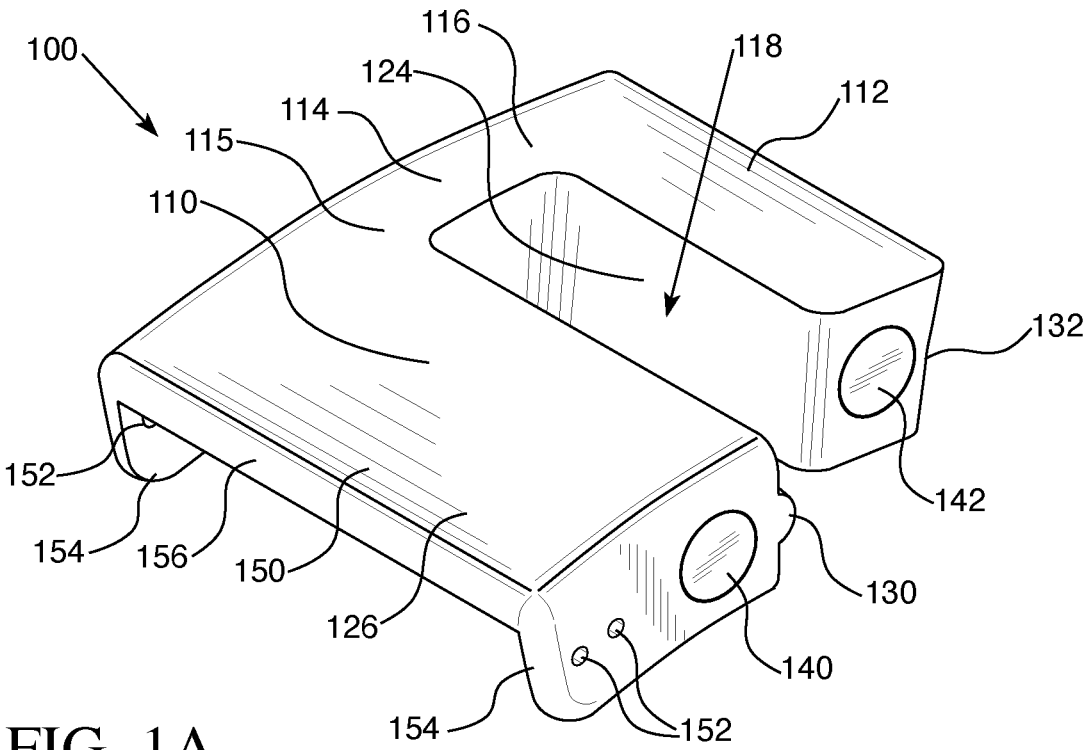
FIG. 1A depicts a perspective view of an interlocking member according to an embodiment of the invention.
Figure 1B:
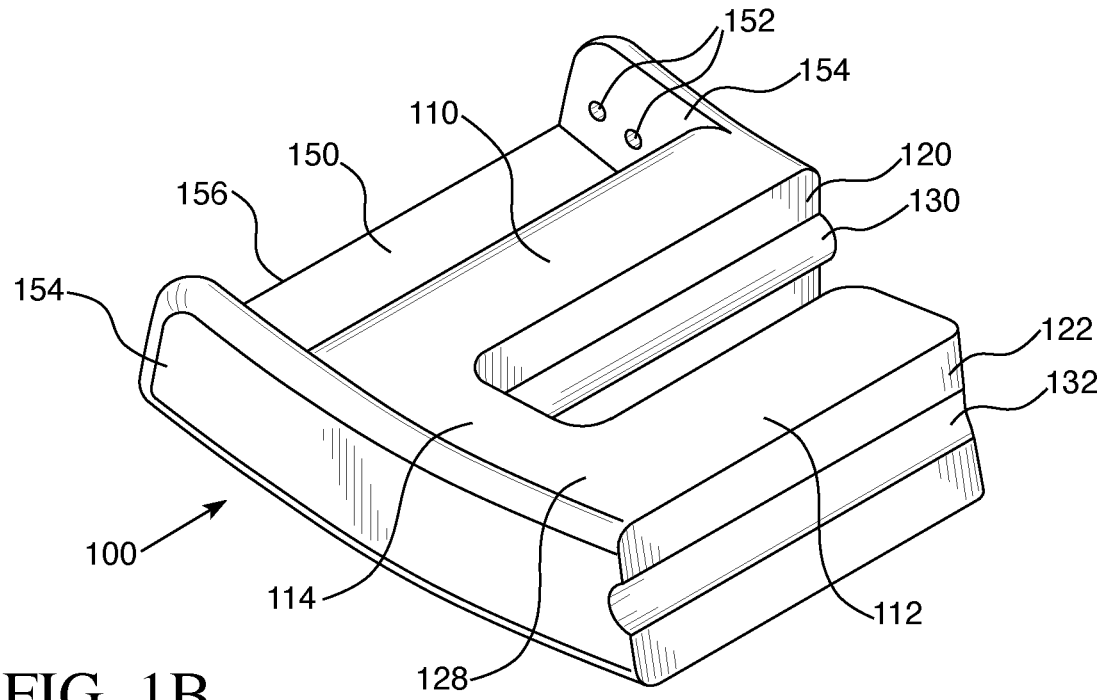
FIG. 1B depicts a perspective view of the underside of the interlocking member of FIG. 1 according to an embodiment of the invention.
Figure 1C:
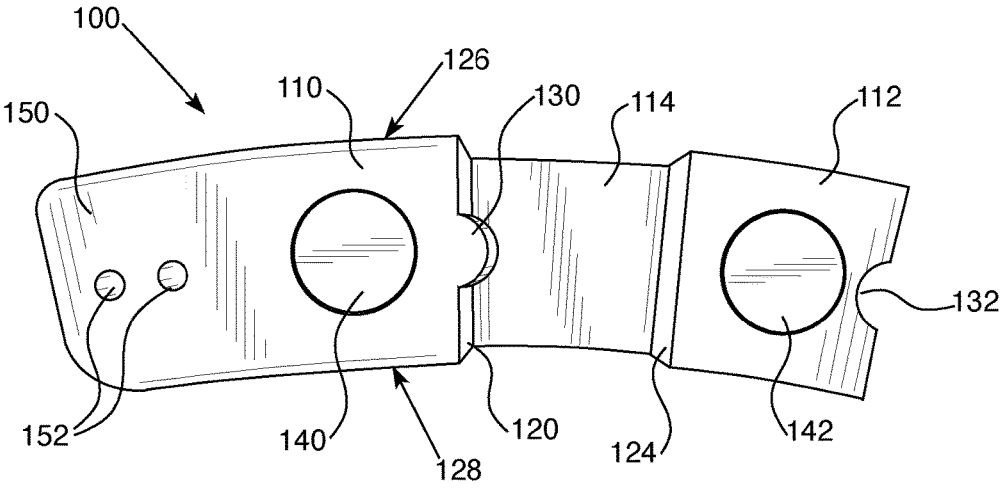
FIG. 1C depicts a side view of the interlocking member of FIG. 1 according to an embodiment of the invention.

FIG. 1A, FIG. 1B, and FIG. 1C depict an interlocking member 100 according to an embodiment of the invention. The interlocking member 100 is comprised of a first elongated portion 110, a second elongated portion 112, a first bridge portion 114, and a first overhang portion 150.

In the illustrated embodiment, the first elongated portion 110 forms a substantially cuboid shape and includes a first engagement surface 120, a first ridge 130, and a first magnet 140. The first engagement surface 120 is located on a surface of the first elongated portion 110 that is substantially perpendicular to both the exterior surface 126 and the contact surface 128. Protruding from the first elongated portion 110 is a first ridge 130 that extends along the entire length of the first engagement surface 120. The first ridge 130 has a substantially semi-circular cross-section and is disposed along the approximate middle-line of the first engagement surface 120. It is to be understood that in other embodiments the first ridge 130 may have a differently shaped cross-section, may be disposed along a different line of the first engagement surface 120, and may not extend the entire length of the first engagement surface 120. For instance, in another embodiment the first ridge 130 may have a cross-section that is rectangular, triangular, circular, or any other shape. The first ridge 130 may be disposed along any line that extends parallel to the length of the first engagement surface 120, including a line that is off-center from the midline, or a line that coincides with the outer edge of the first engagement surface 120. Additionally, the first ridge 130 may only extend along a fraction of the length of the first engagement surface 120.

In the illustrated embodiment, a first magnet 140 is embedded within the first elongated portion 110. The first magnet 140 is located proximal to the first engagement surface 120 and has a circular cross-section. The first magnet 140 may be a cylindrical magnet with a length that extends along the length of the first engagement surface 120. The first magnet 140 may be contained within a borehole 244 that is formed in the first elongated portion 110. The first magnet 140 may be coupled to the first elongated portion 110 by mechanical friction, adhesive, or any other means of fastening. In the illustrated embodiment, the first magnet 140 is diametrically magnetized, meaning that it is magnetized through the width of the magnet. The first magnet 140 is disposed within the borehole 244 such that one side of the magnet with a first polarity faces towards the first engagement surface 120 and the other side of the magnet with an opposite polarity faces away from the first engagement surface 120. The first magnet 140 may be made from any type of magnetized material such as neodymium iron boron, samarium cobalt, alnico, ceramic magnet, ferrite magnet, or the like. Additionally, it is to be understood that in other embodiments the first magnet 140 may be of any shape including, but not limited to, a cuboid, a triangular prism, a sphere, or the like. In other embodiments, the first magnet 140 may be affixed to an outer surface of the first elongated portion 110 rather than being embedded in the first elongated portion 110. Alternatively, the first elongated portion 110 itself may be made of a magnetized material.

In the illustrated embodiment, the second elongated portion 112 forms an approximately cuboid shape and includes a second engagement surface 122, a first attachment surface 124, a first groove 132, and a second magnet 142. The second engagement surface 122 is located on a surface of the second elongated portion 112 that is perpendicular to both the exterior surface 126 and the contact surface 128. The second engagement surface 122 is distal to and opposite from the first attachment surface 124. The first attachment surface 124 faces towards the first engagement surface 120. The first engagement surface 120, the first attachment surface 124, and the second engagement surface 122 are all surfaces that are substantially parallel to one another. In the illustrated example, the second elongated portion 112 is shorter than the first elongated portion 110. In other embodiments, the second elongated portion 112 may be longer than or the same length as the first elongated portion 110.

In the illustrated embodiment, a first groove 132 is disposed along the entire length the second engagement surface 122. The first groove 132 has a substantially semi-circular cross-section and is disposed along the approximate middle-line of second engagement surface 122. It is to be understood that in other embodiments the first groove 132 may have a differently shaped cross-section, may be disposed along a different line of the second engagement surface 122, and may not extend the entire length of the second engagement surface 122. For instance, in another embodiment the first groove 132 may have a cross-section that is rectangular, triangular, circular, or any other shape. The first groove 132 may be disposed along any line that extends parallel to the length of the second engagement surface 122, including a line that is off-center from the midline, or a line that coincides with the outer edge of the second engagement surface 122. Additionally, the first groove 132 may only extend along a fraction of the length of the second engagement surface 122. The first groove 132 is dimensioned and configured to slidably receive and slidably engage with a ridge of substantially similar dimensions to the first ridge 130 located on the first elongated portion 110.

In the illustrated embodiment, a second magnet 142 is embedded within the second elongated portion 112. The second magnet 142 is located proximal to the second engagement surface 122 and has a circular cross-section. The second magnet 142 may be a cylindrical magnet with a length that extends along the length of the second engagement surface 122. The second magnet 142 may be contained within a borehole 244 that is formed in the second elongated portion 112. The second magnet 142 may be coupled to the second elongated portion 112 by mechanical friction, adhesive, or any other means of fastening. In the illustrated embodiment, the second magnet 142 is diametrically magnetized, meaning that it is magnetized through the width of the magnet. The second magnet 142 is disposed within a borehole 244 such that the side of the second magnet 142 facing towards the second engagement surface 122 has a polarity that is opposite to the side of the first magnet 140 that faces towards the first engagement surface 120. The second magnet 142 is disposed such that it has a polarity orientation that is opposite to the polarity orientation of the first magnet 140. In other embodiments, the first magnet 140 and the second magnet 142 may have the same polarity orientation. The second magnet 142 may be made from any type of magnetized material such as neodymium iron boron, samarium cobalt, alnico, ceramic magnets, ferrite magnets, or the like. Additionally, it is to be understood that in other embodiments the second magnet 142 may be of any shape, including but not limited to, a cuboid, a triangular prism, a sphere, or the like. In other embodiments, the second magnet 142 may be affixed to an outer surface of the second elongated portion 112 rather than being embedded in the second elongated portion 112. Alternatively, the second elongated portion 112 itself may be made of a magnetized material.

In the illustrated embodiment, a first bridge portion 114 is disposed between the first elongated portion 110 and the second elongated portion 112 and serves to connect the two elongated portions together. The first bridge portion 114 has a substantially cuboid shape and is substantially shorter in length than the first elongated portion 110 and the second elongated portion 112. The first bridge portion 114 comprises a first end 115 and a second end 116. The first end 115 is connected to the first engagement surface 120 of the first elongated portion 110, and the second end 116 is connected to the first attachment surface 124 of the second elongated portion 112. The first bridge portion 114 is connected to distal ends of the first elongated portion 110 and the second elongated portion 112. A continuous surface may be formed by the first elongated portion 110, the first bridge portion 114, and the second elongated portion 112. The first bridge portion 114 is disposed between the first elongated portion 110 and the second elongated portion 112 such that a negative space or open-ended channel 118 is created between the first elongated portion 110 and second elongated portion 112. The open-ended channel 118, which has a substantially U-shaped cross-section, is formed by the first elongated portion 110, the first bridge portion 114, and the second elongated portion 112. The open-ended channel 118 is dimensioned such that a second elongated portion 112 of another interlocking member 100 can fit within it.

In the illustrated embodiment, the interlocking member 100 may comprise a first overhang portion 150 that extends from the first elongated portion 110. The first overhang portion 150 may extend from a side of the first elongated portion 110 that is distal to and opposite from the first engagement surface 120. The first overhang portion 150 serves to facilitate connection of a belt or strap 256 to the interlocking member 100. In the illustrated embodiment, the first overhang portion 150 comprises two side panels 154 and an overhang panel 156. Each side panel 154 extends from opposing outer edges of the interlocking member 100. The overhang panel 156 extends from an edge of the first elongated portion 110 that is proximal to the exterior surface 126. A negative space is created between the side panels 154 and the overhang panel 156 such that a strap 256 can be received. In the illustrated embodiment, there are two first channels 152 that extend through both of the side panels 154. In other embodiments there may not be any first channels 152 or there may be one or more first channels 152. Each first channel 152 extends substantially parallel to the first ridge 130 of the first engagement surface 120 and to the first groove 132 of the second engagement surface 122. Each first channel 152 is dimensioned to receive a first rod 254 that a belt or strap 256 may be attached to.

In the illustrated embodiment, the interlocking member 100 is manufactured out of a single piece of material. The first elongated portion 110, second elongated portion 112, first bridge portion 114, and first overhang portion 150 may be cast or machined as a single piece according to well-known techniques. Boreholes 244 may be machined or cast into the first elongated portion 110 and the second elongated portion 112 to allow magnets to be inserted. In other embodiments, the first elongated portion 110, the second elongated portion 112, the first bridge portion 114, and the first overhang portion 150 may all be separately manufactured components that are affixed together via welding, adhesive, mechanical fasteners, or any other fastening means. Additionally, there are two magnets in the illustrated embodiment: a first magnet 140 in the first elongated portion 110 and a second magnet 142 in the second elongated portion 112. In other embodiments, there may be no magnets, only one magnet, or any other number of magnets. Additionally, if one or more magnets are included, they may be coupled to any of the first elongated portion 110, the second elongated portion 112, or the first bridge portion 114. The location of the magnets may be changed in other embodiments. For instance, an embodiment of the invention may include only one magnet that is embedded in the second elongated portion 112.

FIG. 1B shows the underside of the interlocking member 100 of FIG. 1A. A contact surface 128 refers to the surface of the interlocking member 100 or fastening apparatus 200 that makes contact with the wearer of the fastening apparatus 200. The contact surface 128 is opposite to and distal to the exterior surface 126. In the illustrated embodiment, the contact surface 128 is curved. A curved contact surface 128 is dimensioned to conform to contours of the wearer's body. For instance, in an embodiment of the fastening apparatus 200 that is used to secure a waist belt to a person's waist, the curved contact surface 128 conforms to the curved exterior surface 126 of the wearer's waist. In an embodiment of the fastening apparatus 200 that is used to secure a wrist watch to a person's wrist, the curved contact surface 128 conforms to the curved exterior surface 126 of the wearer's wrist. In the illustrated embodiment, the interlocking member 100 has a curved contact surface 128 and a curved exterior surface 126. In other embodiments, the interlocking member 100 may have a planar contact surface 128 and planar exterior surface 126. In other embodiments, the contact surface 128 and exterior surface 126 may both be curved, may both be planar, or one may be curved and the other planar.

FIG. 1C depicts a side view of the interlocking member 100. In the illustrated embodiment, the contact surface 128 and the exterior surface 126 each have a curvature that corresponds to an arc of a theoretical circle. The curvature of the exterior surface 126 corresponds to an arc of a theoretical circle with a radius that is larger than the radius of the theoretical circle corresponding to the contact surface 128. In other embodiments, the curvature of the exterior surface 126 may correspond to an arc of a circle with a radius that is equal to or smaller than the radius of the theoretical circle corresponding to the curvature of the contact surface 128.

A fastening apparatus 200 may be comprised of a pair of interlocking members 100. When one interlocking member 100 is rotated by 180 degrees relative to the other interlocking member 100, the two interlocking members 100 may be slidably and removably engaged with one another to form a secure mechanical connection. The first ridge 130 of one interlocking member 100 may slidably engage with the corresponding first groove 132 of the other interlocking member 100. The first groove 132 of one interlocking member 100 may slidably engage with the first ridge 130 of the other interlocking member 100.

In an alternative embodiment to the one shown in FIG. 1A, FIG. 1B, and FIG. 1C, the locations of the first ridge 130 and the first groove 132 may be swapped so that first ridge 130 is disposed on the second elongated portion 112 and the first groove 132 is disposed on the first elongated portion 110. Specifically, the first ridge 130 may be disposed on the second engagement surface 122 of the second elongated portion 112 instead of on the first engagement surface 120 of the first elongated portion 110, and the first groove 132 may be disposed on the first engagement surface 120 of the first elongated portion 110 instead of on the second engagement surface 122 of the second elongated portion 112. A fastening apparatus 200 comprised of two interlocking members 100 with this alternative configuration of first ridge 130 and first groove 132 functions identically to the configuration illustrated in the figures: the first ridge 130 and first groove 132 of one interlocking member 100 slidably engage with the corresponding first groove 132 and first ridge 130 of the other interlocking member 100, respectively.

Figure 2A:
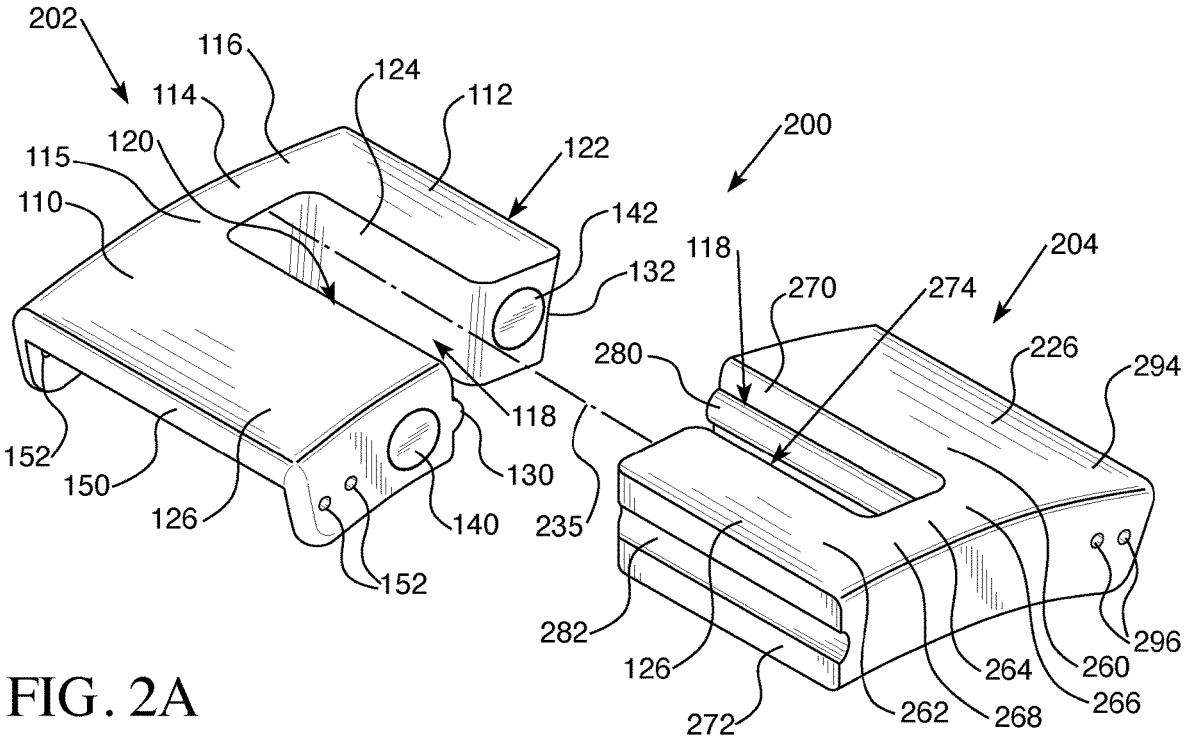
FIG. 2A depicts a perspective view of a fastening apparatus in a disengaged state according to an embodiment of the invention
Figure 2B:
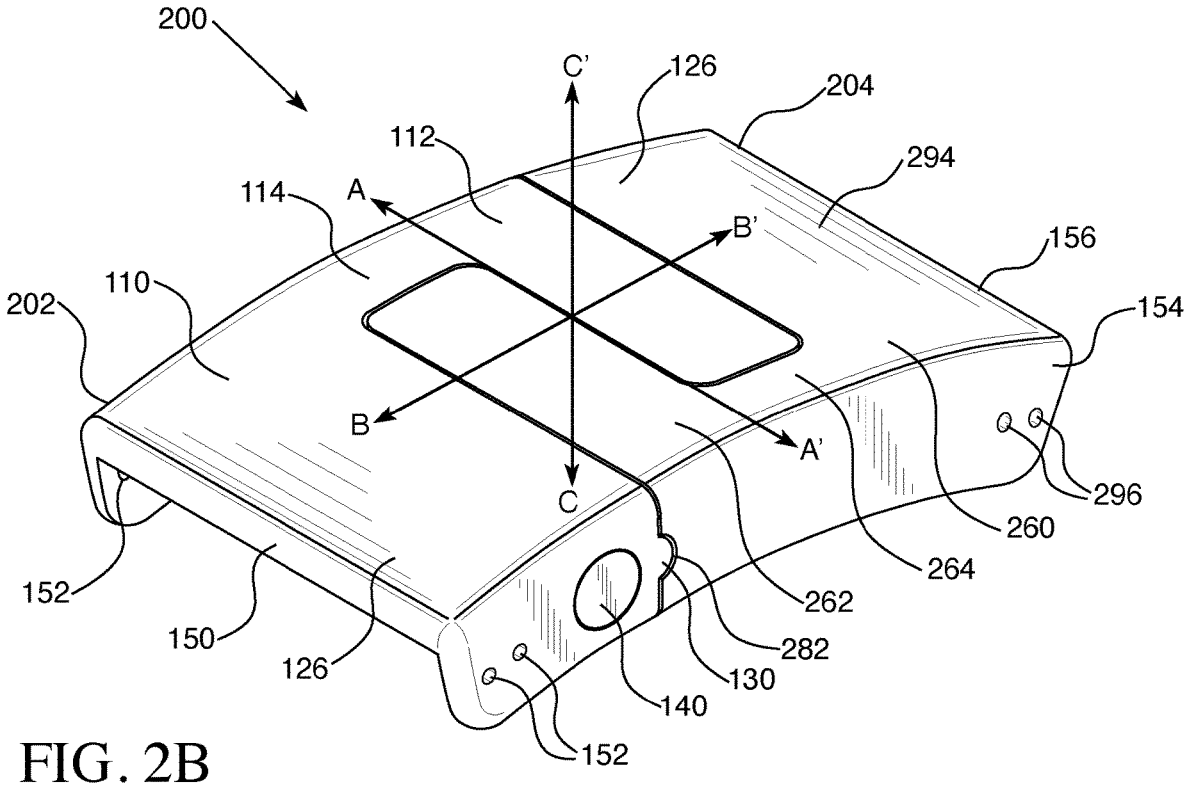
FIG. 2B depicts a perspective view of the fastening apparatus of FIG. 2A in an interlocked state according to an embodiment of the invention.
Figure 2C:
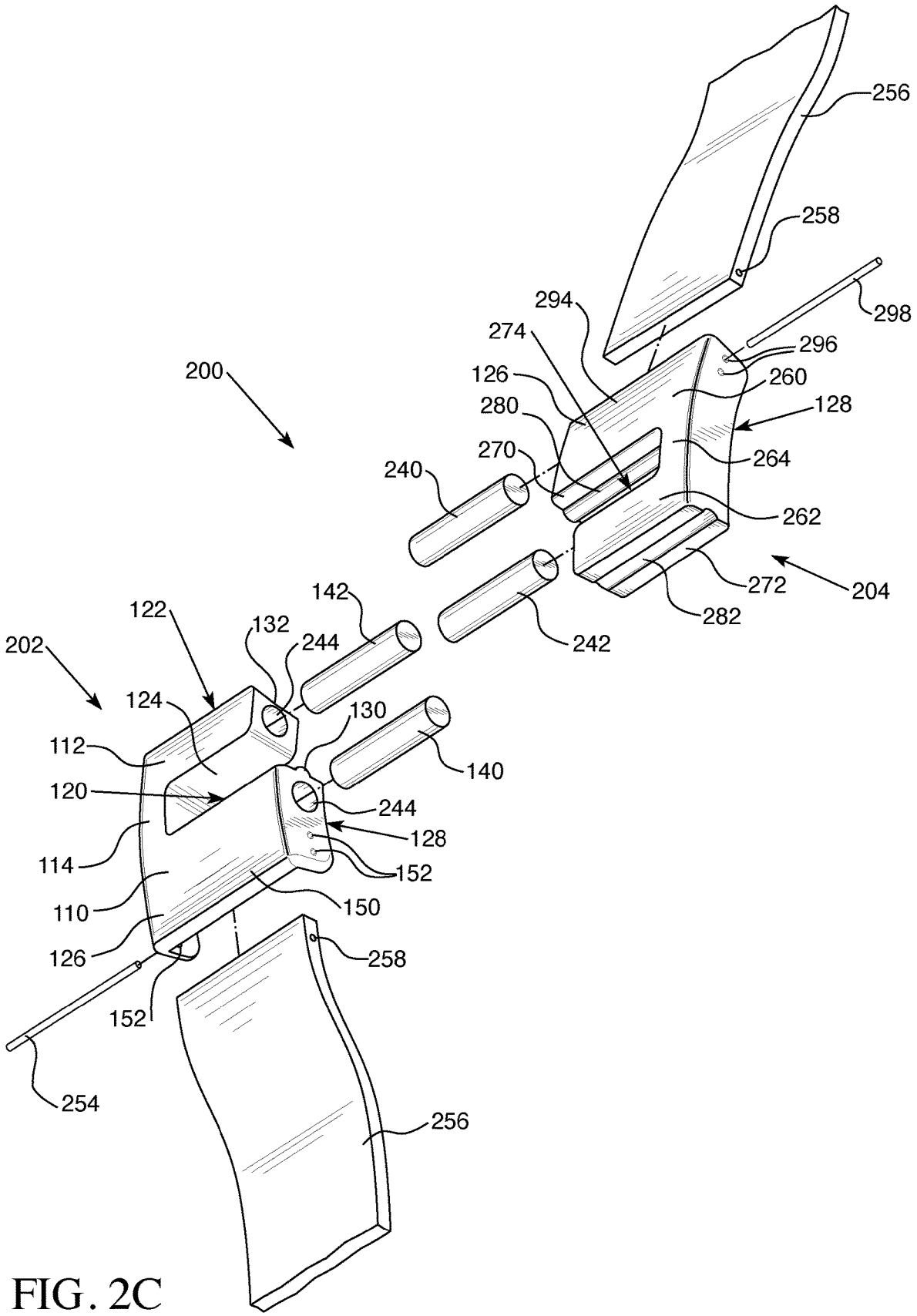
FIG. 2C depicts an exploded view of example components of a fastening apparatus according to an embodiment of the invention.

FIG. 2A, FIG. 2B, and FIG. 2C depict a fastening apparatus 200 comprised of a first interlocking member 202 and a second interlocking member 204 according to an embodiment of the invention. In the illustrated embodiment, the construction of the first interlocking member 202 is substantially identical to the second interlocking member 204 in regards to shape, dimensions, elements, and configuration of elements. Additionally, the first interlocking member 202 and the second interlocking member 204 are both substantially equivalent to the interlocking member 100 of FIG. 1A, FIG. 1B, and FIG. 1C. The second interlocking member 204 has merely been rotated 180 degrees to engage with the first interlocking member 202.

The first interlocking member 202 comprises a first elongated portion 110, a second elongated portion 112, and a first bridge portion 114. A first engagement surface 120 is disposed on the first elongated portion 110. A first ridge 130 protrudes along the length of the first engagement surface 120. A first magnet 140 is embedded in the first elongated portion 110. A second engagement surface 122 is disposed on the second elongated portion 112. A first groove 132 extends along the length of the second engagement surface 122. A first attachment surface 124 is disposed on a surface of the second elongated portion 112 that is distal to the second engagement surface 122. A second magnet 142 is embedded in the second elongated portion 112. The first bridge portion 114 has a first end 115 and a second end 116. The first end 115 is attached to the first elongated portion 110 and the second end 116 is attached to the second elongated portion 112. A first overhang portion 150 may extend from a side of the first elongated portion 110 that is distal to the first engagement surface 120. The first overhang portion 150 may additionally comprise one or more first channels 152 therethrough.

The second interlocking member 204 comprises a third elongated portion 260, a fourth elongated portion 262, and a second bridge portion 264. A third engagement surface 270 is disposed on the third elongated portion 260. A second ridge 280 protrudes along the length of the third engagement surface 270. A third magnet 240 is embedded in the third elongated portion 260. A fourth engagement surface 272 is disposed on the fourth elongated portion 262. A second groove 282 extends along the length of the fourth engagement surface 272. A second attachment surface 274 is disposed on a surface of the fourth elongated portion 262 that is distal to the fourth engagement surface 272. A fourth magnet 242 is embedded in the fourth elongated portion 262. The second bridge portion 264 has a third end 266 and a fourth end 268. The third end 266 is attached to the third elongated portion 260 and the fourth end 268 is attached to the fourth elongated portion 262. A second overhang portion 294 may extend from a side of the third elongated portion 260 that is distal to the third engagement surface 270. The second overhang portion 294 may additionally comprise one or more second channels 296 therethrough.

In the illustrated embodiment, the third elongated portion 260 forms a substantially cuboid shape and includes a third engagement surface 270, a second ridge 280, and a third magnet 240. The third engagement surface 270 is located on a surface of the third elongated portion 260 that is substantially perpendicular to the exterior surface 126 and the contact surface 128. Protruding from the third elongated portion 260 is a second ridge 280 that extends along the entire length of the third engagement surface 270. The second ridge 280 has a substantially semi-circular cross-section and is disposed along the approximate middle-line of the third engagement surface 270. It is to be understood that in other embodiments the second ridge 280 may have a differently shaped cross-section, may be disposed along a different line of the third engagement surface 270, and may not extend the entire length of the third engagement surface 270. For instance, in another embodiment the second ridge 280 may have a cross-section that is rectangular, triangular, circular, or any other shape. The second ridge 280 may be disposed along any line that extends parallel to the length of the third engagement surface 270, including a line that is off-center from the midline, or a line that coincides with the outer edge of the third engagement surface 270. Additionally, the second ridge 280 may only extend along a fraction of the length of the third engagement surface 270. The second ridge 280 is dimensioned and configured to slidably receive and slidably engage with the first groove 132 located on the second elongated portion 112.

In the illustrated embodiment, a third magnet 240 is embedded within the third elongated portion 260. The third magnet 240 is located proximal to the third engagement surface 270 and has a circular cross-section. The third magnet 240 may be a cylindrical magnet with a length that extends along the length of the third engagement surface 270. The third magnet 240 may be contained within a borehole 244 that is formed in the third elongated portion 260. The third magnet 240 may be coupled to the third elongated portion 260 by mechanical friction, adhesive, or any other means of fastening. In the illustrated embodiment, the first magnet 140 is diametrically magnetized, meaning that it is magnetized through the width of the magnet. The third magnet 240 is disposed within the borehole 244 such that one side of the magnet with a first polarity faces towards the third engagement surface 270 and the other side of the magnet with an opposite polarity faces away from the third engagement surface 270. The third magnet 240 is configured to attract to the second magnet 142. The third magnet 240 may be made from any type of magnetized material such as neodymium iron boron, samarium cobalt, alnico, ceramic magnets, ferrite magnets, or the like. Additionally, it is to be understood that in other embodiments the third magnet 240 may be of any shape including, but not limited to, a cuboid, a triangular prism, a sphere, or the like. In other embodiments, the third magnet 240 may be affixed to an outer surface of the third elongated portion 260 rather than being embedded in the third elongated portion 260. Alternatively, the third elongated portion 260 itself may be made of a magnetized material.

In the illustrated embodiment, the fourth elongated portion 262 forms an approximately cuboid shape and includes a fourth engagement surface 272, a second attachment surface 274, a second groove 282, and a fourth magnet 242. The fourth engagement surface 272 is located on a surface of the fourth elongated portion 262 that is perpendicular to both the exterior surface 126 and the contact surface 128. The fourth engagement surface 272 is distal to and opposite from the second attachment surface 274. The second attachment surface 274 faces towards the third engagement surface 270. The third engagement surface 270, the second attachment surface 274, and the fourth engagement surface 272 are all surfaces that are substantially parallel to one another. In the illustrated example, the fourth elongated portion 262 is shorter than the third elongated portion 260. In other embodiments, the fourth elongated portion 262 may be longer than or the same length as the third elongated portion 260.

In the illustrated embodiment, a second groove 282 is disposed along the entire length the fourth engagement surface 272. The second groove 282 has a substantially semi-circular cross-section and is disposed along the approximate middle-line of fourth engagement surface 272. It is to be understood that in other embodiments the second groove 282 may have a differently shaped cross-section, may be disposed along a different line of the fourth engagement surface 272, and may not extend the entire length of the fourth engagement surface 272. For instance, in another embodiment the second groove 282 may have a cross-section that is rectangular, triangular, circular, or any other shape. The second groove 282 may be disposed along any line that extends parallel to the length of the fourth engagement surface 272, including a line that is off-center from the midline, or a line that coincides with the outer edge of the fourth engagement surface 272. Additionally, the second groove 282 may only extend along a fraction of the length of the fourth engagement surface 272. The second groove 282 is dimensioned and configured to slidably receive and slidably engage with the first ridge 130 located on the first elongated portion 110.

In the illustrated embodiment, a fourth magnet 242 is embedded within the fourth elongated portion 262. The fourth magnet 242 is located proximal to the fourth engagement surface 272 and has a circular cross-section. The fourth magnet 242 may be a cylindrical magnet with a length that extends along the length of the fourth engagement surface 272. The fourth magnet 242 may be contained within a borehole 244 that is formed in the fourth elongated portion 262. The fourth magnet 242 may be coupled to the fourth elongated portion 262 by mechanical friction, adhesive, or any other means of fastening. In the illustrated embodiment, the fourth magnet 242 is diametrically magnetized, meaning that it is magnetized through the width of the magnet. The fourth magnet 242 is configured to attract the first magnet 140. The fourth magnet 242 is disposed within the borehole 244 such that the side of the fourth magnet 242 facing towards the fourth engagement surface 272 has a polarity that is opposite to the side of the third magnet 240 that faces the third engagement surface 270. The fourth magnet 242 is disposed such that it has a polarity orientation that is opposite to the polarity orientation of the third magnet 240. In other embodiments, the third magnet 240 and the fourth magnet 242 may have the same polarity orientation. The fourth magnet 242 may be made from any type of magnetized material such as neodymium iron boron, samarium cobalt, alnico, ceramic magnets, ferrite magnets, or the like. Additionally, it is to be understood that in other embodiments the fourth magnet 242 may be of any shape, including but not limited to, a cuboid, a triangular prism, a sphere, or the like. In other embodiments, the fourth magnet 242 may be affixed to an outer surface of the fourth elongated portion 262 rather than being embedded in the fourth elongated portion 262. Alternatively, the fourth elongated portion 262 itself may be made of a magnetized material.

In the illustrated embodiment, a second bridge portion 264 is disposed between the third elongated portion 260 and the fourth elongated portion 262 and serves to connect the two elongated portions together. The second bridge portion 264 has a substantially cuboid shape and is substantially shorter in length than the third elongated portion 260 and the fourth elongated portion 262. The second bridge portion 264 comprises a third end 266 and a fourth end 268. The third end 266 is connected to the third engagement surface 270 of the third elongated portion 260 and the fourth end 268 is connected to the fourth attachment surface of the fourth elongated portion 262. The second bridge portion 264 is connected to distal ends of the third elongated portion 260 and the fourth elongated portion 262. A continuous surface may be formed by the third elongated portion 260, the second bridge portion 264, and the fourth elongated portion 262. The second bridge portion 264 is disposed between the third elongated portion 260 and the fourth elongated portion 262 such that a negative space or open-ended channel 118 is created between the third elongated portion 260 and the fourth elongated portion 262. The open-ended channel 118, which has a substantially U-shaped cross-section, is formed by the third elongated portion 260, the second bridge portion 264, and the fourth elongated portion 262. The open-ended channel 118 is dimensioned to receive the second elongated portion 112 of the first interlocking member 202.

In the illustrated embodiment, the fastening apparatus 200 may comprise a second overhang portion 294 that extends from the third elongated portion 260. The second overhang portion 294 may extend from a side of the third elongated portion 260 that is distal to and opposite from the third engagement surface 270. The second overhang portion 294 serves to facilitate connection of a belt or strap 256 to the second interlocking member 204. In the illustrated embodiment, the second overhang portion 294 comprises two side panels 154 and an overhang panel 156. Each side panel 154 extends from opposing outer edges of the second interlocking member 204. The overhang panel 156 extends from an edge of the third elongated portion 260 that is proximal to the exterior surface 126. A negative space is created between the side panels 154 and the overhang panel 156 such that a strap 256 can be received. In the illustrated embodiment, there are two second channels 296 that extend through both of the side panels 154. In other embodiments there may no second channels 296 or only one second channel 296. Each second channel 296 extends substantially parallel to the second ridge 280 of the third engagement surface 270 and to the second groove 282 of the fourth engagement surface 272. Each second channel 296 is dimensioned to receive a second rod 298 that a belt or strap 256 may be attached to.

In the illustrated embodiment, the second interlocking member 204 is manufactured out of a single piece of material. The third elongated portion 260, fourth elongated portion 262, second bridge portion 264, and second overhang portion 294 may be cast or machined as a single piece according to well-known techniques. Boreholes 244 may be machined or cast into the third elongated portion 260, the second elongated portion 112, or the second bridge portion 264 to allow magnets to be inserted. In other embodiments, the third elongated portion 260, the fourth elongated portion 262, the second bridge portion 264, and the second overhang portion 294 may all be separately manufactured components that are affixed together via welding, adhesive, mechanical fasteners, or any other fastening means. Additionally, in the illustrated embodiment there are two magnets coupled to the second interlocking member 204: a third magnet 240 in the third elongated portion 260 and a fourth magnet 242 in the fourth elongated portion 262. In other embodiments, there may be no magnets, only one magnet, or any other number of magnets. Additionally, if one or more magnets are included, they may be coupled to any of the third elongated portion 260, the fourth elongated portion 262, or the second bridge portion 264. The location of the magnets may be changed in other embodiments. For instance, an embodiment of the invention may include only one magnet that is embedded in the fourth elongated portion 262.

FIG. 2A depicts a fastening apparatus 200 in a disengaged state. An engagement axis 235 is illustrated to show how the first interlocking member 202 and the second interlocking member 204 can be interlocked together. The first interlocking member 202 can be removably engaged with the second interlocking member 204 by sliding the two interlocking members together. Upon the first interlocking member 202 and second interlocking member 204 being slid together along the engagement axis 235 illustrated in FIG. 2A, the first engagement surface 120 slidably engages with the fourth engagement surface 272, and the second engagement surface 122 slidably engages with the third engagement surface 270. Accordingly, the first ridge 130 slidably engages with the second groove 282, and the first groove 132 slidably engages with the second ridge 280. The ridges and grooves serve to facilitate proper alignment of the first interlocking member 202 with the second interlocking member 204. For example, upon engagement of the two interlocking members, the exterior surface 126 of the first interlocking member 202 may be flush with the exterior surface 126 of the second interlocking member 204. Additionally, the contact surface 128 of the first interlocking member 202 may be flush with the contact surface 128 of the second interlocking member 204. The ridges and grooves additionally provide mechanical resistance to relative movement of the first interlocking member 202 and the second interlocking member 204 that is in a direction along the C-C' axis.

The magnets serve to facilitate engagement of the two interlocking members. The polarity orientation of the first magnet 140 is disposed to attract the fourth magnet 242 and the polarity orientation of the second magnet 142 is disposed to attract the third magnet 240. Upon the first magnet 140 coming within proximity to the fourth magnet 242, the first magnet 140 and the fourth magnet 242 exert a magnetic force on one another that pulls them together. Similarly, upon the second magnet 142 coming within proximity to the third magnet 240, the second magnet 142 and the third magnet 240 exert a magnetic force on one another that pulls them together. The magnetic attraction between each pair of magnets causes the first interlocking member 202 and the second interlocking member 204 to be pulled together along the engagement axis 235, resulting in the two interlocking members being engaged together. Thus, the magnetic attraction between interlocking members makes it easier for the user to align the first interlocking member 202 with the second interlocking member 204 and slidably engage them together. In some embodiments, powerful magnets, such as neodymium iron boron magnets may be used. In those embodiments, the magnetic attraction between the two interlocking members will cause the interlocking members to interlock along the engagement axis 235 with minimal user intervention: merely placing the first interlocking member 202 close to the second interlocking member 204 will cause them to be pulled together into an interlocked state.

The magnets additionally serve to hold the two interlocking members together once the first interlocking member 202 and the second interlocking member 204 are in an interlocked state. The magnetic attraction between the first magnet 140 and the fourth magnet 242 and the magnetic attraction between the second magnet 142 and the third magnet 240 provide resistance to relative lateral movements of the first interlocking member 202 and the second interlocking member 204 in directions parallel to the A-A' axis. In other words, the magnetic attraction provides resistance to the first interlocking member 202 and the second interlocking member 204 being pulled apart along an axis parallel to the A-A' axis.

FIG. 2B depicts a fastening apparatus 200 in an interlocked state according to an embodiment of the invention. The fastening apparatus 200 comprises a first interlocking member 202 and a second interlocking member 204. In the illustrated embodiment, when the two interlocking members are interlocked, the second elongated portion 112 is removably disposed between the third elongated portion 260 and the fourth elongated portion 262. The second elongated portion 112 fits into the substantially U-shaped, open-ended channel 118 created by the third elongated portion 260, the fourth elongated portion 262, and the second bridge portion 264. A surface of the second elongated portion 112 may engage with a surface of the second bridge portion 264. The fourth elongated portion 262 is removably disposed between the first elongated portion 110 and the second elongated portion 112. The fourth elongated portion 262 fits into the substantially U-shaped, open-ended channel 118 created by the first elongated portion 110, the second elongated portion 112, and the first bridge portion 114. A surface of the fourth elongated portion 262 may engage with a surface of the first bridge portion 114. The first attachment surface 124 may engage with the second attachment surface 274. When in an interlocked state, the fastening apparatus 200 forms a substantially cuboid shape with substantially continuous surfaces. The exterior surface of the interlocked fastening apparatus 200 has a substantially symmetrical appearance. When in an interlocked state, the elongated portions provide mechanical resistance against relative lateral movements in directions parallel to the B-B' axis (parallel to the longitudinal direction of any straps 256 coupled to the fastening apparatus 200). Thus, when in an interlocked state, the fastening apparatus 200 provides resistance to movement along at least three perpendicular axes: magnetic resistance to movement along the A-A' direction via the magnets, mechanical resistance to movement along the B-B' direction via the elongated portions, and mechanical resistance to movement along the C-C' direction via the ridges and grooves.

Once in an interlocked position, the first interlocking member 202 may be disengaged from the second interlocking member 204 by pulling the first interlocking member 202 and the second interlocking member 204 in opposite directions along the A-A' axis. Once a sufficient force is exerted to overcome the magnetic attraction, the first interlocking member 202 and the second interlocking member 204 may separate from one another.

FIG. 2C depicts an exploded view of example components of a fastening apparatus 200 according to an embodiment of the invention. The first magnet 140, second magnet 142, third magnet 240, and fourth magnet 242 may be disposed into boreholes 244 within the first elongated portion 110, second elongated portion 112, third elongated portion 260, and fourth elongated portion 262, respectively. The first interlocking member 202 may further comprise a first rod 254 that extends through the first channel 152. The first rod 254 may couple a strap 256 to the first interlocking member 202 by extending through both the first channel 152 and a strap channel 258 of the strap 256. The second interlocking member 204 may further comprise a second rod 298 that extends through the second channel 296. The second rod 298 may couple a strap 256 to the second interlocking member 204 by extending through both the second channel 296 and a strap channel 258 of the strap 256.

The first rod 254 and the second rod 298 may be any elongated structure that is suitable for securing a strap 256. For instance, the first rod 254 and the second rod 298 each may be a cylindrical rod that is permanently affixed to the interlocking member. In another embodiment, the first rod 254 and the second rod 298 each may be a spring rod that can be detached from the interlocking member. The first rod 254 and the second rod 298 each may be made from any material, such as plastic, metal, ceramic, rubber, polymer, glass, steel, steel alloy, iron, aluminum, titanium, gold, silver, or the like. In other embodiments, a strap 256 may be attached directly to the first elongated portion 110 via any other fastening method including, but not limited to, stitching, adhesive, welding, or the like. Alternatively, the first rod 254 and the second rod 298 may be integrally connected to the first interlocking member 202 and second interlocking member 204, respectively.

Figure 3:
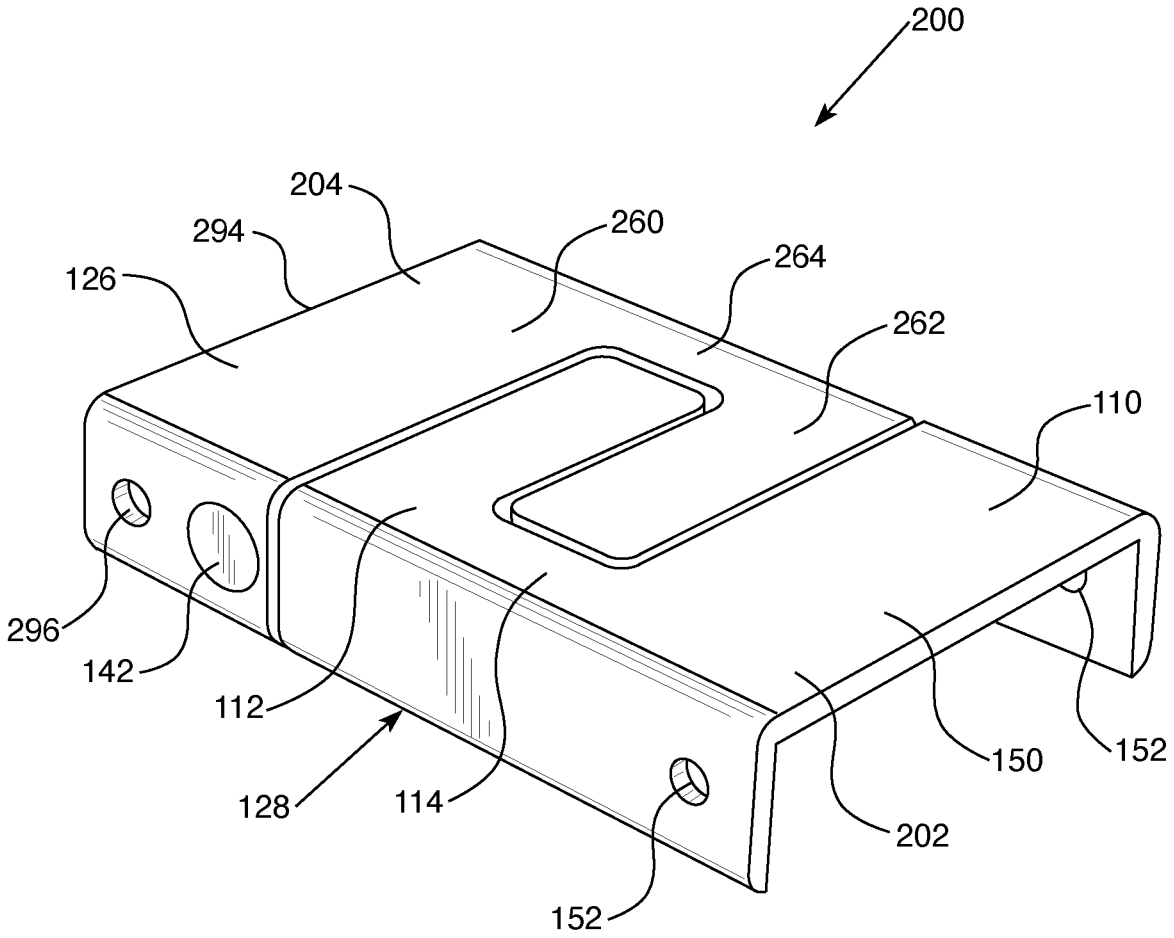
FIG. 3 depicts a perspective view of a fastening apparatus with a planar contact surface according to an embodiment of the invention.

FIG. 3 depicts a fastening apparatus 200 comprising a first interlocking member 202 and a second interlocking member 204 according to an alternative embodiment of the invention. In the illustrated embodiment, the fastening apparatus 200 has a contact surface 128 that is planar and an exterior surface 126 that is planar. The first interlocking member 202 and the second interlocking member 204 are engaged in an interlocked state. The first interlocking member 202 comprises a first elongated portion 110, a second elongated portion 112, and a first bridge portion 114. The first bridge portion 114 has a first end 115 and a second end 116. The first end 115 is attached to the first elongated portion 110 and the second end 116 is attached to the second elongated portion 112. A first overhang portion 150 may extend from a side of the first elongated portion 110. The first overhang portion 150 may additionally comprise one or more channels therethrough. A first magnet 140 (not shown) is embedded in the first elongated portion 110. The second interlocking member 204 comprises a third elongated portion 260, a fourth elongated portion 262, and a second bridge portion 264. The second bridge portion 264 has a third end 266 and a fourth end 268. The third end 266 is attached to the third elongated portion 260 and the fourth end 268 is attached to the fourth elongated portion 262. A second overhang portion 294 may extend from a side of the third elongated portion 260. The second overhang portion 294 may additionally comprise one or more channels therethrough. A second magnet 142 is shown embedded in the third elongated portion 260.

In different embodiments, the fastening apparatus 200 and each of the interlocking member 100, the first interlocking member 202, and the second interlocking member 204 may be composed of any material, such as, aluminum, plastic, rubber, polymer, steel, titanium, metal alloy, metal, ceramic, glass, wood, or the like. In any embodiment of the invention, the fastening apparatus 200 or interlocking member 100 may be dimensioned for use in various applications. For instance, the fastening apparatus 200 of an embodiment of the invention may be used as a fastening device for waist belts, wrist watches, jewelry chains, jewelry ropes, shoes, bags, personal floatation devices, or any other object. The fastening apparatus 200 or interlocking member 100 may be scaled up or scaled down to any size according to any intended use.

It is to be understood by a person having ordinary skill in the art, that the exact configuration of elements shown in the figures is not the only configuration of elements that can be used to perform the invention. Specifically, the locations of the grooves and ridges is not limited to the exact locations that are shown in the illustrated embodiments. The location of the grooves and ridges may be changed, switched, swapped, or altered without affecting the performance of the invention. In other embodiments, each of the first ridge 130, first groove 132, second ridge 280, and second groove 282 may be coupled to any of the first elongated portion 110, second elongated portion 112, third elongated portion 260, or fourth elongated portion 262. Specifically, each of the first ridge 130, first groove 132, second ridge 280, and second groove 282 may be disposed along any of the first engagement surface 120, second engagement surface 122, first attachment surface 124, third engagement surface 270, fourth engagement surface 272, and second attachment surface 274. In other embodiments, the fastening apparatus may comprise one or more ridges and one or more grooves. In other embodiments, the ridge(s) (first ridge 130 and/or second ridge 280) and groove(s) (first groove 132 and/or second groove 282) may be located on any portion of either interlocking member (first interlocking member 202 and/or second interlocking member 204) such that the groove(s) of one interlocking member slidably engage(s) with the corresponding ridge(s) of the other interlocking member.

Additionally, in alternative embodiments, the first interlocking member 202 and the second interlocking member 204 may not have identical constructions relative to one another. Rather the first interlocking member 202 may have a configuration of elements that is different to the configuration of elements of the second interlocking member 204.

In one such alternative embodiment, the fastening apparatus 200 comprises a first interlocking member 202 and a second interlocking member 204 that removably engages with the first interlocking member 202. The first interlocking member 202 comprises a first elongated portion 110, a second elongated portion 112, a first bridge portion 114, and a first ridge 130. A first engagement surface 120 is disposed on the first elongated portion 110. A second engagement surface 122 is disposed on the second elongated portion 112. A first attachment surface 124 is disposed on a surface of the second elongated portion 112 that is distal to the second engagement surface 122. The first bridge portion 114 is disposed between the first elongated portion 110 and the second elongated portion 112. An open-ended channel 118 with a substantially U-shaped cross-section may be formed by the first elongated portion 110, the second elongated portion 112, and the first bridge portion 114. The first elongated portion 110 may be longer than, shorter than, or the same length as the second elongated portion 112. The first ridge 130 extends along the first elongated portion 110 and may comprise a portion of the first engagement surface 120. The second interlocking member 204 comprises a third elongated portion 260, a fourth elongated portion 262, a second bridge portion 264, and a first groove 132. A third engagement surface 270 is disposed on the third elongated portion 260. A fourth engagement surface 272 is disposed on the fourth elongated portion 262. A second attachment surface 274 is disposed on a surface of the fourth elongated portion 262 that is distal to the fourth engagement surface 272. The second bridge portion 264 is disposed between the third elongated portion 260 and the fourth elongated portion 262. An open-ended channel 118 with a substantially U-shaped cross-section may be formed by the third elongated portion 260, the fourth elongated portion 262, and the second bridge portion 264. The third elongated portion 260 may be longer than, shorter than, or the same length as the fourth elongated portion 262. The first groove 132 extends along the fourth elongated portion 262 and may comprise a portion of the fourth engagement surface 272. The first groove 132 is dimensioned, shaped, and sized to slidably engage with the first ridge 130.

In a variation of the current embodiment, the locations of the first ridge 130 and the first groove 132 may be swapped so that the first ridge 130 is located on the fourth elongated portion 262 and the first groove 132 is located on the first elongated portion 110. The first ridge 130 may comprise a portion of the fourth engagement surface 272, and the first groove 132 may comprise a portion of the first engagement surface 120.

In another variation of the current embodiment, the locations of the first ridge 130 and the first groove 132 may be changed so that the first ridge 130 is located on the second elongated portion 112 and the first groove 132 is located on the fourth elongated portion 262. The first ridge 130 may comprise a portion of the first attachment surface 124, and the first groove 132 may comprise a portion of the second attachment surface 274.

In another variation of the current embodiment, the locations of the first ridge 130 and the first groove 132 may be changed so that the first ridge 130 is located on the fourth elongated portion 262 and the first groove 132 is located on the second elongated portion 112. The first ridge 130 may comprise a portion of the second attachment surface 274, and the first groove 132 may comprise a portion of the first attachment surface 124.

In another variation of the current embodiment, the locations of the first ridge 130 and the first groove 132 may be changed so that the first ridge 130 is located on the second elongated portion 112 and the first groove 132 is located on the third elongated portion 260. The first ridge 130 may comprise a portion of the second engagement surface 122, and the first groove 132 may comprise a portion of the third engagement surface 270.

In another variation of the current embodiment, the locations of the first ridge 130 and the first groove 132 may be changed so that the first ridge 130 is located on the third elongated portion 260 and the first groove 132 is located on the second elongated portion 112. The first ridge 130 may comprise a portion of the third engagement surface 270, and the first groove 132 may comprise a portion of the second engagement surface 122.

In the current embodiment or in any variations thereof, the fastening apparatus 200 may be comprised of additional elements. For instance, a first magnet 140 may be coupled to either of the first elongated portion 110, the second elongated portion 112, or the first bridge portion 114. A second magnet 142 may be coupled to either the third elongated portion 260, the fourth elongated portion 262, and the second bridge portion 264. The second magnet 142 may be oriented such that it attracts the first magnet 140. Additional magnets may be coupled to the first elongated portion 110, the second elongated portion 112, the first bridge portion 114, the third elongated portion 260, the fourth elongated portion 262, and the second bridge portion 264. Any of the magnets may be embedded into fastening apparatus 200, or they may be affixed to the fastening apparatus 200, or portions of the fastening apparatus 200 may be magnetized.

The current embodiment and any variations thereof may additionally comprise all or any combination of the following components: a first overhang portion 150, a first rod 254, a second overhang portion 294, and a second rod 298. The first overhang portion 150 may extend from the first elongated portion 110. One or more first channels 152 may be formed through the first overhang portion 150. A first rod 254 may be disposed coaxially along the first channel 152 for attachment to a strap 256. The second overhang portion 294 may extend from the third elongated portion 260. One or more second channels 296 may be formed through the second overhang portion 294. A second rod 298 may be disposed coaxially along the first channel 152 for attachment to a strap 256.

In another alternative embodiment, a fastening apparatus 200 may be comprised of a first interlocking member 202 and a second interlocking member 204 that removably engage with one another. The first interlocking member 202 comprises a first elongated portion 110, a second elongated portion 112, and a first bridge portion 114. A first engagement surface 120 is disposed on the first elongated portion 110. A second engagement surface 122 is disposed on the second elongated portion 112. A first attachment surface 124 is disposed on a surface of the second elongated portion 112 that is distal to the second engagement surface 122. The second interlocking member 204 comprises a third elongated portion 260, a fourth elongated portion 262, and a second bridge portion 264. A third engagement surface 270 is disposed on the third elongated portion 260. A fourth engagement surface 272 is disposed on the fourth elongated portion 262. A second attachment surface 274 is disposed on a surface of the fourth elongated portion 262 that is distal to the fourth engagement surface 272. In alternative embodiments, the fastening apparatus 200 may further comprise any number or combination of a first ridge 130, first groove 132, second ridge 280, or second groove 282.

In one variation of an alternative embodiment, the first ridge 130 may be disposed along the first attachment surface 124 of the second elongated portion 112, the first groove 132 may be disposed along the second engagement surface 122 of the second elongated portion 112, the second ridge 280 may be disposed along the third engagement surface 270 of the third elongated portion 260, and the second groove 282 may be disposed along the second attachment surface 274 of the fourth elongated portion 262.

In another variation of an alternative embodiment, the first groove 132 may be disposed along the first attachment surface 124 of the second elongated portion 112, the first ridge 130 may be disposed along the second engagement surface 122 of the second elongated portion 112, the second groove 282 may be disposed along the third engagement surface 270 of the third elongated portion 260, and the second ridge 280 may be disposed along the second attachment surface 274 of the fourth elongated portion 262.

In another variation of an alternative embodiment, the first ridge 130 may be disposed along the first attachment surface 124 of the second elongated portion 112, the second ridge 280 may be disposed along the second engagement surface 122 of the second elongated portion 112, the first groove 132 may be disposed along the third engagement surface 270 of the third elongated portion 260, and the second groove 282 may be disposed along the second attachment surface 274 of the fourth elongated portion 262.

In another variation of an alternative embodiment, the first groove 132 may be disposed along the first attachment surface 124 of the second elongated portion 112, the second groove 282 may be disposed along the second engagement surface 122 of the second elongated portion 112, the first ridge 130 may be disposed along the third engagement surface 270 of the third elongated portion 260, and the second ridge 280 may be disposed along the second attachment surface 274 of the fourth elongated portion 262.

In another variation of an alternative embodiment, the first ridge 130 may be disposed along the second engagement surface 122 of the second elongated portion 112, the first groove 132 may be disposed along the first engagement surface 120 of the first elongated portion 110, the second ridge 280 may be disposed along the fourth engagement surface 272 of the fourth elongated portion 262, and the second groove 282 may be disposed along the third engagement surface 270 of the third elongated portion 260.

In another variation of an alternative embodiment, the first ridge 130 may be disposed along the first engagement surface 120 of the first elongated portion 110, the second ridge 280 may be disposed along the second engagement surface 122 of the second elongated portion 112, the first groove 132 may be disposed along the third engagement surface 270 of the third elongated portion 260, and the second groove 282 may be disposed along the fourth engagement surface 272 of the fourth elongated portion 262.

In another variation of an alternative embodiment, the first groove 132 may be disposed along the first engagement surface 120 of the first elongated portion 110, the second groove 282 may be disposed along the second engagement surface 122 of the second elongated portion 112, the first ridge 130 may be disposed along the third engagement surface 270 of the third elongated portion 260, and the second ridge 280 may be disposed along the fourth engagement surface 272 of the fourth elongated portion 262.

In any embodiment of the invention or in any variations thereof, the fastening apparatus 200 may further comprise any combination or number of the following elements: a first magnet 140, a second magnet 142, a third magnet 240, a fourth magnet 242, a first overhang portion 150, and a second overhang portion 294. For instance, a first magnet 140 may be coupled to either of the first elongated portion 110, the second elongated portion 112, or the first bridge portion 114. A second magnet 142 may be coupled to either of the third elongated portion 260, the fourth elongated portion 262, and the second bridge portion 264. The second magnet 142 may be oriented such that it attracts the first magnet 140. Additional magnets may be coupled to the first elongated portion 110, the second elongated portion 112, the first bridge portion 114, the third elongated portion 260, the fourth elongated portion 262, and the second bridge portion 264. Any of the magnets may be embedded into fastening apparatus 200, or they may be affixed to the fastening apparatus 200, or portions of the fastening apparatus 200 may be magnetized. The first interlocking member 202 may comprise zero or one or more magnets. The second interlocking member 204 may comprise zero or one or more magnets. A first overhang portion 150 may extend from a side of the first elongated portion 110 that is distal to the first engagement surface 120. The first overhang portion 150 may additionally comprise one or more first channels 152 therethrough. A second overhang portion 294 may extend from a side of the third elongated portion 260 that is distal to the third engagement surface 270. The second overhang portion 294 may additionally comprise one or more second channels 296 therethrough.

I claim:

1. A fastening apparatus comprising:

two interlocking members including a first interlocking member and a second interlocking member that each have an identical, U-shape and which have legs of the U-shape that interlock with each other in an inverted orientation;

the first interlocking member comprising:

a first elongated portion that comprises a first leg of the U-shape, the first elongated portion comprising:

a first engagement surface comprising a first ridge; and a first magnet embedded in the first elongated portion;

a second elongated portion that comprises a second leg of the U-shape and forms a first open-ended channel between itself and the first elongated portion, the second elongated portion comprising:

a second engagement surface comprising a first groove;

a first attachment surface that is distal to the second engagement surface; and a second magnet embedded in the second elongated portion; and a first bridge portion comprising a first end and a second end, wherein the first end is coupled to the first engagement surface and the second end is coupled to the first attachment surface; and wherein the second interlocking member is shaped and configured to removably engage with the first interlocking member by sliding into the first interlocking member in a direction defined by a first axis A-A', the second interlocking member formed in the U-shape and comprising:

a third elongated portion that comprises a third leg of the U-shape, the third elongated portion comprising:

a third engagement surface comprising a second ridge, wherein the second ridge is configured to slidably engage with the first groove; and a third magnet embedded in the third elongated portion, wherein the third magnet is configured to attract the second magnet;

wherein a surface of the second elongated portion may engage with another surface; and a fourth elongated portion that comprises a fourth leg of the U-shape that slides within the first open-ended channel of the first interlocking member, the fourth elongated portion comprising:

a fourth engagement surface comprising a second groove, wherein the second groove is configured to slidably engage with the first ridge; and a second attachment surface that is distal to the fourth engagement surface; and a fourth magnet embedded in the fourth elongated portion, wherein the fourth magnet is configured to attract the first magnet; and a second bridge portion that creates the U-shape, a second open-ended channel for the second elongated portion to fit into, comprising:

a third end and a fourth end, wherein the third end is coupled to the third engagement surface and the fourth end is coupled to the second attachment surface;

wherein, when the two interlocking members are slid together into an interlocked state, the second elongated portion is removably disposed between the third elongated portion and the fourth elongated portion that results in resistance to movement along at least three perpendicular axes including:

magnetic resistance to movement along the first axis direction via the magnets;

mechanical resistance to movement along a second axis, B-B', perpendicular to the first axis and running in a direction parallel to a belt coupled to the fastening apparatus; and mechanical resistance to movement along a third axis, C-C', in a direction normal/perpendicular to a plane defined by the first axis and the second axis;

wherein the resistance to the movement is provided via magnetic attraction between the magnets and engagement of the ridges and grooves, which are formed in the elongated portions, with each other.

2. The fastening apparatus of claim 1, wherein:

the first open-ended channel having a U-shaped cross-section is formed by the first elongated portion, the second elongated portion, and the first bridge portion; and the second open-ended channel having a U-shaped cross-section is formed by the third elongated portion, the fourth elongated portion, and the second bridge portion.

3. The fastening apparatus of claim 1, further comprising:

a first overhang portion extending from the first interlocking member, wherein the first overhang portion is configured to couple to a strap; and a second overhang portion extending from the second interlocking member, wherein the second overhang portion is configured to couple to a strap.

4. The fastening apparatus of claim 1, wherein a contact surface of the fastening apparatus is curved.

5. The fastening apparatus of claim 1, wherein the first elongated portion is longer than the second elongated portion, and the third elongated portion is longer than the fourth elongated portion.

6. The fastening apparatus of claim 1, wherein the second magnet has a polarity orientation opposite to a polarity orientation of the first magnet, and the fourth magnet has a polarity orientation opposite to a polarity orientation of the third magnet.

7. An interlocking member comprising:

a first interlocking member and a second interlocking member that each have an identical, U-shape and which have legs of the U-shape that interlock with each other in an inverted orientation;

the first interlocking member comprising:

a first elongated portion that comprises a first leg of the U-shape, the first elongated portion comprising:

a first engagement surface comprising a first ridge located on the first elongated portion; and a first magnet embedded in the first elongated portion, and the first bridge portion;

a second elongated portion that comprises a second leg of the U-shape and forms a first open-ended channel between itself and the first elongated portion, the second elongated portion comprising:

a second engagement surface comprising a first groove located on the second elongated portion;

a first attachment surface that is distal to the second engagement surface; and a second magnet embedded in the second elongated portion; and a first bridge portion comprising a first end and a second end, wherein the first end is coupled to the first engagement surface and the second end is coupled to the first attachment surface; and wherein the second interlocking member is shaped and configured to removably engage with the first interlocking member by sliding into the first interlocking member in a direction defined by a first axis A-A', the second interlocking member formed in a U-shape and comprising:

a third elongated portion that comprises a third leg of the U-shape, the third elongated portion comprising:

a third engagement surface comprising a second ridge, wherein the second ridge is configured to slidably engage with the first groove; and a third magnet embedded in the third elongated portion, wherein the third magnet is configured to attract the first-second magnet;

wherein a surface of the second elongated portion may engage with another surface; and a fourth elongated portion that comprises a fourth leg of the U-shape that slides within the first open-ended channel of the first interlocking member, the fourth elongated portion comprising:

a fourth engagement surface comprising a second groove, wherein the second groove is configured to slidably engage with the second first ridge; and a second attachment surface that is distal to the fourth engagement surface; and a fourth magnet embedded in the fourth elongated portion, wherein the fourth magnet is configured to attract the first magnet; and a second bridge portion that creates the U-shaped, a second open-ended channel for the second elongated portion to fit into, comprising:

a third end and a fourth end, wherein the third end is coupled to the third engagement surface and the fourth end is coupled to the second attachment surface;

wherein, when the two interlocking members are slid together into an interlocked state, the second elongated portion is removably disposed between the third elongated portion and the fourth elongated portion that results in resistance to movement along at least three perpendicular axes including:

magnetic resistance to movement along the first axis direction via the magnets;

mechanical resistance to movement along a second axis, B-B', perpendicular to the first axis and running in a direction parallel to a belt coupled to the fastening apparatus; and mechanical resistance to movement along a third axis, C-C', in a direction normal/perpendicular to a plane defined by the first axis and the second axis;

wherein the resistance to the movement is provided via magnetic attraction between the magnets and engagement of the ridges and the grooves, which are formed in the elongated portions, with each other.

8. The fastening apparatus of claim 7, wherein the first open-ended channel having a U-shaped cross-section is formed by the first elongated portion, the second elongated portion, and the first bridge portion.

9. The interlocking member of claim 7, further comprising a first overhang portion extending from the first elongated portion, wherein the first overhang portion is configured to couple to a strap.

10. The interlocking member of claim 7, wherein a contact surface of the interlocking member is curved.

11. The interlocking member of claim 7, wherein a contact surface of the interlocking member is planar.

12. The fastening apparatus of claim 7, wherein the first elongated portion is longer than the second elongated portion.

13. A fastening apparatus comprising:

a first interlocking member and a second interlocking member that each have an identical, U-shape and which have legs of the U-shape that interlock with each other in an inverted orientation;

the first interlocking member comprising:

a first elongated portion that comprises a first leg of the U-shape, the first elongated portion comprising:

a first engagement surface comprising a first ridge located on the first elongated portion; and a first magnet embedded in the first elongated portion;

a second elongated portion that comprises a second leg of the U-shape and forms a first open-ended channel between itself and the first elongated portion, the second elongated portion comprising:

a second engagement surface comprising a first groove located on the second elongated portion;

a first attachment surface that is distal to the second engagement surface; and a second magnet embedded in the second elongated portion; and a first bridge portion comprising a first end and a second end, wherein the first end is coupled to the first engagement surface and the second end is coupled to the first attachment surface; and wherein the second interlocking member is shaped and configured to removably engage with the first interlocking member by sliding into the first interlocking member in a direction defined by a first axis A-A', the second interlocking member formed in the U-shape and comprising:

a third elongated portion that comprises a third leg of the U-shape, the third elongated portion comprising:

a third engagement surface comprising a second ridge, wherein the second ridge is configured to slidably engage with the second first groove; and a third magnet embedded in the third elongated portion, wherein the third magnet is configured to attract the first second magnet;

wherein a surface of the second elongated portion may engage with another surface; and a fourth elongated portion that comprises a fourth leg of the U-shape that slides within the first open-ended channel of the first interlocking member, the fourth elongated portion comprising:

a fourth engagement surface comprising a second groove, wherein the second groove is configured to slidably engage with the first ridge; and a second attachment surface that is distal to the fourth engagement surface; and a fourth magnet embedded in the fourth elongated portion, wherein the fourth magnet is configured to attract the first magnet; and a second bridge portion, disposed between the third elongated portion and the fourth elongated portion, that creates a U-shaped, a second open-ended channel for the second elongated portion to fit into, comprising:

a third end and a fourth end, wherein the third end is coupled to the third engagement surface and the fourth end is coupled to the second attachment surface;

wherein, when the two interlocking members are slid together into an interlocked state, the second elongated portion is removably disposed between the third elongated portion and the fourth elongated portion that results in resistance to movement along at least three perpendicular axes including:

magnetic resistance to movement along the first axis direction via the magnets;

mechanical resistance to movement along a second axis, B-B', perpendicular to the first axis and running in a direction parallel to a belt coupled to the fastening apparatus; and mechanical resistance to movement along a third axis, C-C', in a direction normal/perpendicular to a plane defined by the first axis and the second axis;

wherein the resistance to the movement is provided via magnetic attraction between the magnets and engagement of the ridges and the grooves, which are formed in the elongated portions, with each other provided the ridges and the grooves with the ability, once in an interlocking position, the first interlocking member may be disengaged from the second interlocking member by pulling the first interlocking member and the second interlocking member in opposite directions along the first axis which simultaneously allows for sufficient force to be exerted to overcome the magnetic attraction, the first interlocking member and the second interlocking member may separate from one another.

14. The fastening apparatus of claim 13, wherein:

the first open-ended channel having a U-shaped cross-section is formed by the first elongated portion, the second elongated portion, and the first bridge portion; and the second open-ended channel having a U-shaped cross-section is formed by the third elongated portion, the fourth elongated portion, and the second bridge portion.

15. The fastening apparatus of claim 13, further comprising:

the first magnet coupled to at least one of the first elongated portion, the second elongated portion, and the first bridge portion; and the second magnet coupled to at least one of the third elongated portion, the fourth elongated portion, and the second bridge portion, wherein the second magnet is configured to attract the first magnet.

16. The fastening apparatus of claim 13, further comprising:

a first overhang portion extending from the first interlocking member, wherein the first overhang portion is configured to couple to a strap; and a second overhang portion extending from the second interlocking member, wherein the second overhang portion is configured to couple to a strap.

17. The fastening apparatus of claim 16, wherein:

the first overhang portion comprises a first channel therethrough and a first rod extending coaxially along the first channel; and the second overhang portion comprises a second channel therethrough and a second rod extending coaxially along the second channel.

18. The fastening apparatus of claim 13, wherein a contact surface of the fastening apparatus is curved.

19. The fastening apparatus of claim 13, wherein the first elongated portion is longer than the second elongated portion, and the third elongated portion is longer than the fourth elongated portion.

20. The fastening apparatus of claim 13, further comprising:

the second groove located on at least one of the first elongated portion, the second elongated portion, the third elongated portion, and the fourth elongated portion; and the second ridge located on at least one of the first elongated portion, the second elongated portion, the third elongated portion, and the fourth elongated portion, wherein the second ridge is configured to slidably engage with the second groove.

* * * * *